US011009279B1

(12) United States Patent
McCarron et al.

(10) Patent No.: US 11,009,279 B1
(45) Date of Patent: May 18, 2021

(54) PORTABLE COOLER WITH INTEGRATED FOLD DOWN SHELF

(71) Applicants: Robert McCarron, Bryn Mawr, PA (US); Ashleigh McCarron, Bryn Mawr, PA (US); Emily McCarron, Bryn Mawr, PA (US)

(72) Inventors: Robert McCarron, Bryn Mawr, PA (US); Ashleigh McCarron, Bryn Mawr, PA (US); Emily McCarron, Bryn Mawr, PA (US)

( * ) Notice: Subject to any disclaimer, the term of this patent is extended or adjusted under 35 U.S.C. 154(b) by 0 days.

(21) Appl. No.: 16/704,691

(22) Filed: Dec. 5, 2019

(51) Int. Cl.

| | |
|---|---|
| ***F25D 3/08*** | (2006.01) |
| ***F25D 25/02*** | (2006.01) |
| ***A47B 96/02*** | (2006.01) |
| *F25D 23/06* | (2006.01) |

(52) U.S. Cl.
CPC ..... *F25D 3/08* (2013.01); *A47B 96/02* (2013.01); *F25D 25/02* (2013.01); *F25D 23/065* (2013.01)

(58) Field of Classification Search
CPC ..... F25D 3/08; F25D 2331/804; F25D 25/02; F25D 3/06; F25D 2400/08; F25D 2400/12; F25D 2400/38; F25D 3/00; F25D 31/002; F25D 3/105; F25D 23/065; A45C 11/20; B62B 2202/52; B62B 2204/06; B62B 5/067; B62B 2202/023; B62B 2204/04; B65D 81/3813; A47B 96/02
USPC ..... 312/351, 408, 400; 62/457.7, 457.1; 220/592.2, 592.03, 592.16, 915.2
See application file for complete search history.

(56) References Cited

U.S. PATENT DOCUMENTS

| | | | | |
|---|---|---|---|---|
| 4,515,421 A * | 5/1985 | Steffes | ..... | A45C 11/20 312/351 |
| 4,581,902 A | 4/1986 | Starck et al. | | |
| 4,775,072 A * | 10/1988 | Lundblade | ..... | A45C 11/20 16/438 |
| 5,480,170 A | 1/1996 | Kaiser, II | | |

(Continued)

FOREIGN PATENT DOCUMENTS

WO 2017/019038 A1 2/2017

OTHER PUBLICATIONS

Igloo, Igloo Maxcold 100 Coolbox 95L, Available at: http://www.campingwithstyle.co.uk/camping-gear-10-of-the-best-passive-camping-coolers-ice-boxes/ (Sep. 24, 2019).

(Continued)

*Primary Examiner* — Hiwot E Tefera
(74) *Attorney, Agent, or Firm* — Volpe Koening

(57) ABSTRACT

A portable cooler with integrated, fold-down shelf adapted for storage within a sidewall of the cooler to facilitate portability and functionality of the cooler. The shelf articulates between a storage position within a recessed portion of the sidewall and a deployed position parallel to the cooler lid for holding food and drink objects. The shelf features a cut-out portion to accommodate use of both the handle and shelf on the same sidewall, and a user may ergonomically access the shelf with a hand and fingers at a lip region of the recessed portion of the sidewall to raise the shelf out of the recessed portion of the sidewall. The handle may be a deployable handle or slidable handle. The cut-out portion of the shelf features a dimensional tolerance to accommodate the functionality of the shelf and handle without either the shelf or handle disturbing or interfering with the other.

20 Claims, 11 Drawing Sheets

(56) References Cited

U.S. PATENT DOCUMENTS

| | | | | |
|---|---|---|---|---|
| 5,730,282 | A | 3/1998 | Bureau | |
| 5,816,433 | A * | 10/1998 | Higgins | A45C 11/20 220/534 |
| 6,176,499 | B1 | 1/2001 | Conrado et al. | |
| 6,216,488 | B1 * | 4/2001 | Rucker | A45B 11/00 62/331 |
| 7,284,393 | B1 * | 10/2007 | Macmillan | B62B 1/22 62/457.7 |
| 7,451,709 | B2 | 11/2008 | Swartfager et al. | |
| 8,181,811 | B1 | 5/2012 | Blake | |
| 9,146,051 | B2 | 9/2015 | Kamin et al. | |
| 9,476,638 | B1 * | 10/2016 | Tyler | F25D 3/06 |
| 2003/0038138 | A1 * | 2/2003 | Komurke | A45C 11/20 220/592.2 |
| 2004/0093892 | A1 * | 5/2004 | Abfalter | F25D 3/08 62/457.7 |
| 2010/0242520 | A1 * | 9/2010 | Weir | F25D 27/00 62/264 |
| 2011/0315695 | A1 * | 12/2011 | Fuqua | A45C 11/20 220/592.16 |
| 2012/0037643 | A1 * | 2/2012 | Matt | A45C 11/20 220/592.2 |
| 2015/0375917 | A1 * | 12/2015 | Lee | B65D 25/28 220/592.03 |
| 2016/0153690 | A1 * | 6/2016 | Patsis | B65D 25/28 222/608 |

OTHER PUBLICATIONS

Coleman, Coleman Cool Box 70Qt Xtreme—66L, Available at: http://www.campingwithstyle.co.uk/camping-gear-10-of-the-best-passive-camping-coolers-ice-boxes/ (Sep. 24, 2019).

Kampa, Kampa Chilly Bin Cooler 50L, Available at: http://www.campingwithstyle.co.uk/camping-gear-10-of-the-best-passive-camping-coolers-ice-boxes/ (Sep. 24, 2019).

* cited by examiner

PORTABLE COOLER WITH INTEGRATED FOLD DOWN SHELF

FIELD OF INVENTION

The present disclosure relates to the field of cooler containers for storage of temperature dependent food and drink objects, and more particularly to portable coolers with dedicated fold-down shelves adapted for integration within the body of the cooler.

BACKGROUND

Coolers that hold food and drink objects at reduced temperatures are known in the art. Because such coolers must maintain the contents at reduced temperatures for prolonged periods of time while also providing additional functionality to access and use the contents, a significant aspect of a cooler involves enhanced accessibility to the items within the cooler without compromising the cooler's portability. A user generally consumes the contents of the cooler within close proximity to the cooler, itself, so the user's ability to enjoy the contents of the cooler, such as additional ice, food or mixers, is compromised when the body of the cooler is equipped with shelves that potentially require secondary assembly and that reside at inconvenient and cumbersome locations on the cooler body, such as on the front side of the cooler, where weight on the shelf may cause the cooler to tip over, or on the lid, such that items within the cooler cannot be accessed without first clearing and opening the lid. Accordingly, there is a need for a portable cooler that provides additional functionality via integrated, deployable shelves that also accommodate the user's manipulation and use of the handles on the sides of the cooler for purposes of portability. It would be advantageous if the portability of the cooler were also supplemented with integrated shelves that collapse and fit within recessed portions within the sides of the cooler body. The shelves of such cooler may allow ergonomic use of the handles and facilitate consumption of the cooler's contents without limitation due to any cumbersome orientation of the shelves on the cooler body.

SUMMARY

There is provided according to the embodiments of the disclosure a portable cooler having integrated, deployable/folding shelves configurable to support contents taken out of the cooler and placed on the shelves. In addition, the deployable shelves may include cut-out portions to enable the handles to deploy through the plane of the integrated shelves, thereby facilitating use of the handles at the sides of the cooler in conjunction with the ability to also operate shelves at the same side-portion of the cooler body.

In one aspect, the present disclosure is directed to a portable cooler comprising a body including a lid and at least one of a sidewall including a shelf disposed at the at least one sidewall, a cut-out portion within the shelf, a recessed portion within the at least one sidewall, and a handle coupled to the at least one sidewall. The shelf is configured to articulate between a storage position within the recessed portion to a deployed position approximately parallel to the lid. In addition, the shelf is approximately flush with the at least one sidewall when in the storage position. Further, the handle is configured to articulate through the cut-out portion between a resting position against the at least one sidewall and a raised position approximately parallel to the lid. Finally, the cut-out portion is configured to allow the shelf to articulate without interfering with the handle and the handle to articulate without interfering with the shelf.

In another aspect, the present disclosure is directed to a portable cooler comprising a body including a lid and at least one of a sidewall including a shelf disposed at the at least one sidewall, a cut-out portion within the shelf, a recessed portion within the at least one sidewall, and a handle coupled to the at least one sidewall. The shelf is configured to articulate between a storage position within the recessed portion to a deployed position approximately parallel to the lid. Further, the shelf is approximately flush with the at least one sidewall when in the storage position. In addition, the handle may be operatively configured to slide within the cut-out portion and onto the shelf when the shelf is in the storage position and thereafter slide within the cut-out portion and off of the shelf and onto the at least one sidewall to allow the shelf to articulate from the storage position to the deployed position. Finally, the cut-out portion is configured to allow the shelf to articulate without interfering with the handle and the handle to slide without interfering with the shelf.

In yet another aspect, the present disclosure is directed to a portable cooler comprising a body including a lid and at least one of a sidewall including a shelf disposed at the at least one sidewall, a cut-out portion within the shelf, a recessed portion within the at least one sidewall, and a handle coupled to the at least one sidewall. The shelf is configured to articulate between a storage position within the recessed portion to a deployed position approximately parallel to the lid. In addition, the shelf is approximately flush with the at least one sidewall when in the storage position. Finally, the cut-out portion is configured to allow the shelf to articulate without interfering with the handle and the handle to articulate without interfering with the shelf.

These and other objects, features and advantages of the present disclosure will be apparent from the following detailed description of illustrative embodiments thereof, which is to be read in connection with the accompanying drawings.

BRIEF DESCRIPTION OF THE DRAWINGS

A more detailed understanding may be had from the following description, given by way of example in conjunction with the accompanying drawings wherein.

DETAILED DESCRIPTION OF THE PREFERRED EMBODIMENTS

Figure 1:
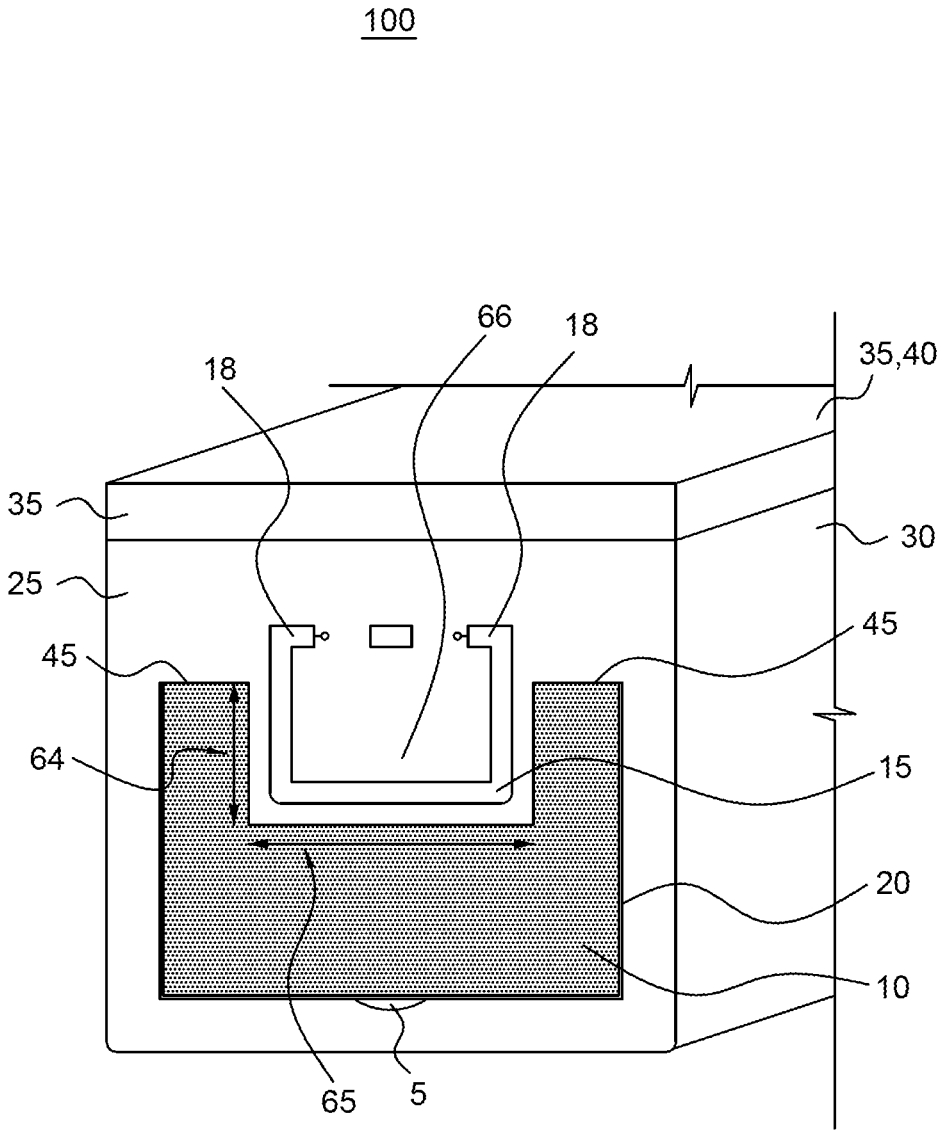
FIG. 1 shows a perspective view of a sidewall of the portable cooler with integrated, deployable shelves, where a shelf is shown in the storage position within a recessed portion of the sidewall and a deployable handle is in the resting position against the sidewall.

Various embodiments are described herein where like references to figures are used to describe like features. Each feature or element may be used alone without other features and elements or in various combinations with or without other features and elements.

The portable cooler with integrated, deployable shelves discussed herein may provide the user with enhanced ergonomic functionality for use and consumption of a cooler's contents, as a user-friendly, convenient way to transport, access and consume the contents within the cooler based upon the features described herein. The cooler may include integrated, deployable shelves located on the sides of the cooler that facilitate portability of the cooler, as the shelves may be flush with the body of the cooler when the shelves are in the storage position within a recessed portion of the cooler sidewall. Since the shelves are integral to the cooler, no additional assembly or attachment of the shelves to the cooler is required. Because the shelves are flush with the cooler sidewalls when not deployed, the cooler may be used without having the shelves positioned in their fully-articulated, deployed position relative to the cooler sidewall. Due to the integrated and flush positioning of the shelves within the recessed portion of the cooler sidewall, the user may not need to remove the shelves or carry them separately when transporting the cooler.

While in the storage position within the cooler sidewalls, the shelves may not protrude from the sidewalls in a manner that would increase the length or width of the cooler body. Accordingly, when in the storage position within the sidewalls, the collapsible shelves enable storage of the cooler in a confined space, while simultaneously enjoying the benefit of a cooler with the supplemental functionality of collapsible shelves that hold and support food and drink objects when the cooler is in use. The shelves may be approximately as large as the dimensions of the sides of the cooler, while also having a suitable dimensional tolerance that allows the shelves to collapse and stow within a recessed portion of the cooler sidewall. In some cases, the shelves may be flush with the cooler sidewall when the shelves are folded down and not deployed.

Further, as will be described in more detail, the shelves may also include a lip or groove to provide ergonomic access by a user's hand or fingers to move the shelves from their storage positions within the cooler sidewall to their deployed position. Because the deployable shelves are located on the sides of the cooler body, the shelves are stable for holding objects, in comparison to shelves located on the front or back sides of the cooler. In addition, because the shelves are located on the sides of the cooler, they may not hinder a user's ability to open the lid.

The shelves may also include a cut-out portion to accommodate the functionality of the handles on the sides of the cooler, so that a user may access and grasp the handles on the sidewall to transport the cooler, in conjunction with the ability to deploy and articulate the shelves to support and hold objects. The cut-out portions of the shelves may enable the handles to deploy and pass through the planes of the shelves, so that a user may use the handles to transport the cooler, without compromising the functionality to articulate the shelves at the sides of the cooler. Additionally, the cut-out portion within the shelves may enable the handles to articulate and deploy without disturbing or interfering with the shelves. In this configuration, the cooler maintains portability via the handles while also having deployable shelves located in the same vicinity on the cooler sidewall as the deployable handles.

The cooler with integrated, collapsible shelves of the herein described embodiments may improve prior cooler configurations that feature shelves that are not designed to integrally fold and collapse into manageable sizes for portability and storage of the cooler. The cooler with integral, collapsible shelves as described herein provides for improved mobility and functionality for the user to transport and enjoy food and drink objects. These and other objects, features and advantages of the example cooler with integral, collapsible shelves will be described in further detail in the following illustrative embodiments thereof.

FIG. 1 is a diagram of an example portable cooler 100 in which one or more disclosed embodiments may be implemented. The portable cooler 100 of FIG. 1 is shown from a side-perspective view where the sidewall 25, front side 30, lid portion 35 and top surface 40 of the lid are visible. Although not shown, it is understood that the cooler 100 includes a rear side and an opposite sidewall and that the opposite sidewall may include the same structures and mechanical features as the sidewall 25 shown in FIG. 1, such as the deployable handle 15 and shelf 10, which will be described in more detail. While the cooler 100 in FIG. 1 is shown with a rectangular shape, it is understood that the cooler 100 may be formed in other shapes, such as a square, for example.

Referring again to FIG. 1, the sidewall 25 may include an integrated, deployable shelf 10 and a deployable handle 15. The deployable shelf 10 may couple to the cooler sidewall 25 at hinges 45, and the deployable handle 15 may also couple to the cooler sidewall 25 at hinges 18. In FIG. 1, the deployable shelf 10 is shown in the storage position within a recessed portion 20 of the sidewall 25 of the cooler body, and the deployable handle 15 is in a resting position against the sidewall 25 of the cooler body. When in the storage position within the recessed portion 20 of the sidewall 25, the deployable shelf 10 is approximately flush with the sidewall 25 so that the exterior surfaces of the sidewall 25 and deployable shelf 10 are approximately even with the imaginary plane running tangentially parallel to the sidewall 25. The deployable shelf 10 may be approximately as large as the dimensions of the sidewall 25 of the cooler, while also having a suitable dimensional tolerance that accommodates the functionality for the deployable shelf 10 to collapse and stow within the recessed portion 20 of the cooler sidewall 25, so that the deployable shelf 10 is approximately flush with the cooler sidewall 25 when folded down in the storage position and not deployed. It is understood that the recessed portion 20 may also feature a suitable dimensional tolerance that accommodates the functionality for the shelf 10 to collapse and stow within the recessed portion 20 of the cooler sidewall 25. For example, the recessed portion 20 may be as wide as the sidewall 25 to accommodate a shelf 10 that is approximately as large as the dimensions of the sidewall 25.

Further, as shown in FIG. 1, the sidewall 25 of the cooler 100 may also feature a deployable handle 15 positioned within a cut-out portion 66 of the deployable shelf 10. As will be described in further detail, the deployable handle 15 may articulate through the plane of the deployable shelf 10 via the cut-out portion 66 within the deployable shelf 10. The cut-out portion 66 enables the user to articulate the handle 15 without touching, interfering with or disturbing the deployable shelf 10, and conversely, the cut-out portion 66 enables the user to articulate the deployable shelf 10 without touching, interfering with or disturbing the handle 15. The cut-out portion 66 may feature a width 64 and a length 65 to provide a suitable dimensional tolerance to accommodate the functionality of both the deployable shelf 10 and handle 15, so that the deployable shelf 10 does not interfere with the respective articulation of the handle 15, and so that the handle 15 does not interfere with the respective articulation of the deployable shelf 10. The width 64 and the length 65 of the cut-out portion may provide a space to accommodate the ergonomic articulation of both the deployable shelf 10 and handle 15 with respect to one another. In addition to the functionality provided by the cut-out portion 66 to accommodate use of both the handle 15 and shelf 10 on the same sidewall 25, a user may access the deployable shelf 10 with a hand and fingers at the lip region 5 of the recessed portion 20 of the sidewall 25 to raise the deployable shelf 10 out of the recessed portion 20 of the sidewall 25. Those skilled in the art would recognize that the material of the deployable shelf 10 may comprise a high-density plastic material or other similar material that is strong, yet light, to accommodate the portability of the cooler 100 and functionality of the deployable shelf 10 for supporting food and drink objects.

Figure 2A:
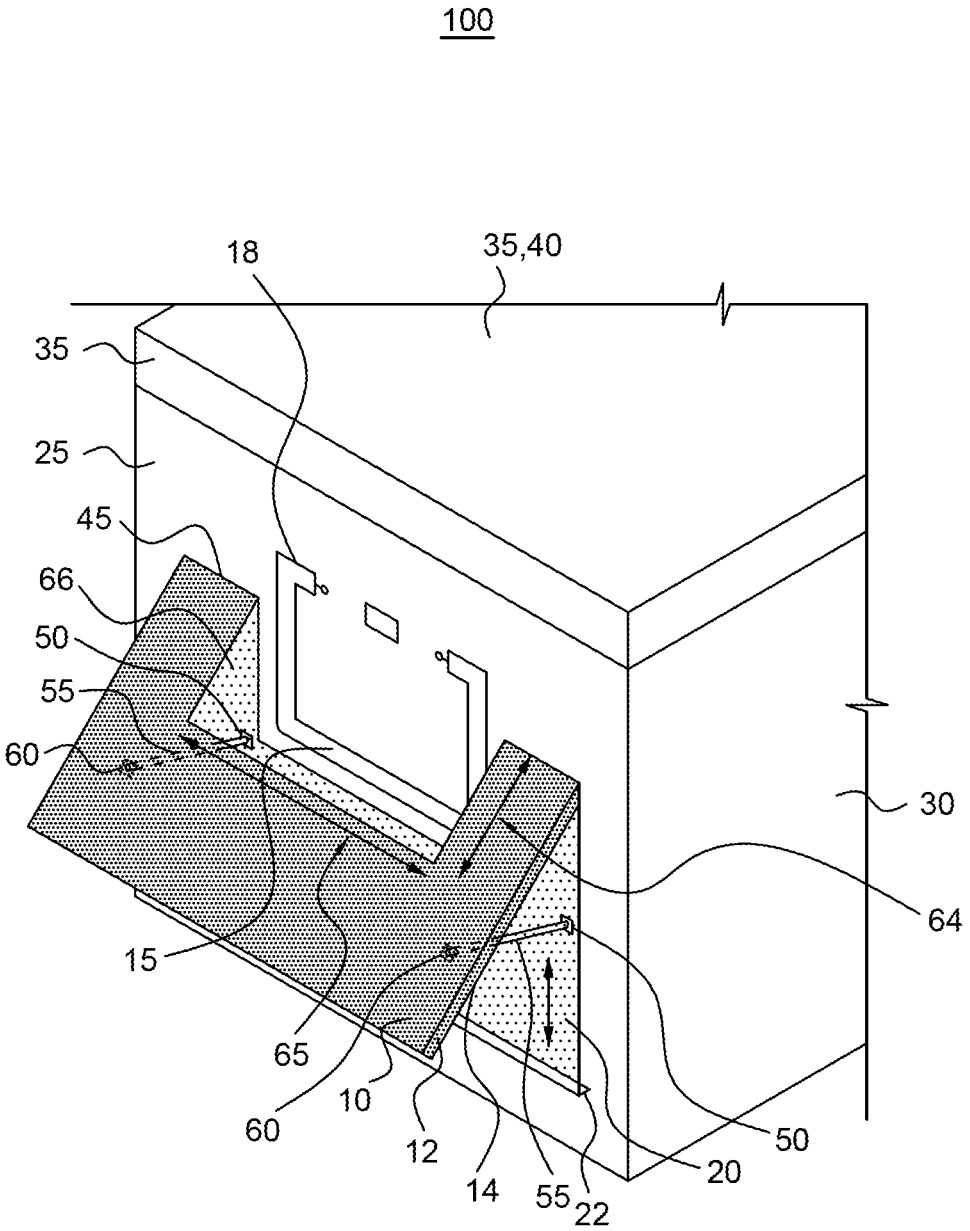
FIG. 2A shows a perspective view of a sidewall of the portable cooler with integrated, deployable shelves, where a shelf is partially deployed out of a recessed portion of the sidewall in an intermediate position, while a deployable handle is in the resting position against the sidewall.

Referring to FIG. 2A, a perspective view of the sidewall 25 of the portable cooler 100 is shown where the deployable shelf 10 is partially deployed out of the recessed portion 20 of the sidewall 25 in an intermediate position. It is understood that when the deployable shelf 10 is in the fully-deployed position outside of the recessed portion 20 of the sidewall 25, the deployable shelf 10 may be approximately parallel to the top surface 40 of the lid 35, so that the deployable shelf 10 provides a level surface to support food and drink objects removed from the interior of the portable cooler 100.

Referring again to FIG. 2A, the deployable shelf 10 may include a height/depth 12, and the recessed portion 20 may also include a depth 22 having a suitable dimensional tolerance to receive the deployable shelf 10 so that the deployable shelf 10 is approximately flush with the cooler sidewall 25 when folded down and in the storage position (as shown in FIG. 1). The depth 22 of the recessed portion 20 of the sidewall 25 may provide the recessed portion 20 with a suitable dimensional tolerance to accommodate the functionality for the deployable shelf 10 to collapse and stow within the recessed portion 20 of the cooler sidewall 25. As aforementioned, the cut-out portion 66 of the deployable shelf 10 may feature a width 64 and a length 65 to provide a suitable dimensional tolerance to accommodate the functionality of both the deployable shelf 10 and handle 15, so that the shelf 10 may articulate without interfering with the handle 15 and the handle 15 may articulate without interfering with the shelf 10.

Further, as shown in FIG. 2A, the cooler 100 may include hinges 50 located within the recessed portion 20 of the sidewall 25 that each couple to a support member 55 that extends to an additional hinge 60 located on the underside 14 of the deployable shelf 10. The hinges 50, 60 and support members 55 stabilize the deployable shelf 10 to secure the deployable shelf 10 while in the storage position within the recessed portion 20 of the sidewall 25 (as shown in FIG. 1), during articulation between the storage and deployed positions, and while in the deployed position where the deployable shelf 10 is approximately parallel to the top surface 40 of the lid 35. Although the embodiment of FIG. 2A shows two support members 55, each accompanied by hinges 50, 60, it is understood that the cooler 100 may feature one support member with hinges 50, 60 that may stabilize the deployable shelf 10 to secure the deployable shelf 10 while in the storage position within the recessed portion 20 of the sidewall 25, during articulation between the storage and deployed positions, and while in the deployed position where the deployable shelf 10 is approximately parallel to the top surface 40 of the lid 35. When a user wishes to raise the deployable shelf shown in FIG. 2A to the fully-deployed position for holding food and drink items, the user may access the deployable shelf 10 with a hand and fingers at the lip region 5 (shown in FIG. 1) of the recessed portion 20 of the sidewall 25 to raise the deployable shelf 10 out of the recessed portion 20 of the sidewall 25. When raising the deployable shelf 10 shown in FIG. 2A, the support members 55 flex on the hinges 50, 60. Mechanisms for lockingly engaging the hinges 50, 60 and support members 55 to securely hold the deployable shelf 10 in the deployed position are known in the art and enable the deployable shelf 10 to support the weight of food and drink objects based on the known locking mechanism for the hinges 50, 60 and support members 55. The support members 55 may feature an appropriate length, as long or as short as necessary, to support the deployable shelf 10 in its horizontal, fully-deployed position to support food and drink items.

In addition, as indicated by the arrows adjacent to the hinges 50 in FIG. 2A, the hinges 50 may slide up or down along the recessed portion 20 of the sidewall 25, so that the support members 55 do not prohibit the deployable shelf 10 from collapsing into the storage position within the recessed portion 20 of the sidewall 25. For example, when a user wishes to fold the deployable shelf 10 down into the storage position within the recessed portion 20 of the sidewall 25, the user may apply pressure to the shelf 10 to fold the shelf 10 down while sliding the hinges 50 up or down along the recessed portion 20 of the sidewall 25 to enable the shelf 10, support members 55 and hinges 50, 60 to stow within the recessed portion 20 of the sidewall 25 so that the shelf 10 may be approximately flush with the sidewall 25 when the shelf 10 is in the storage position. When folding the shelf 10 down into the storage position, the support members 55 may flex on the hinges 50, 60. Mechanisms for lockingly engaging the slidable hinges 50 in place to securely hold the deployable shelf 10 in the deployed position are known in the art and enable the deployable shelf 10 to support the weight of food and drink objects based on the known locking mechanism for the slidable hinges 50. Further, the depth 22 of the recessed portion 20 of the sidewall 25 may also include a suitable dimensional tolerance to allow the shelf 10, including the hinges 50, 60 and support members 55, to stow within the recessed portion 20 of the sidewall 25 in the storage position (as shown in FIG. 1), so that the shelf 10 may be approximately flush with the cooler sidewall 25. Because the depth 22 of the recessed portion 20 of the sidewall 25 may accommodate the dimensions of the hinges 50, 60 and support member 55, the shelf 10 may collapse and stow within the recessed portion 20, so that the shelf 10 does not protrude from the sidewall 25 when the shelf 10 is in the storage position within the recessed portion 20 of the sidewall.

When raising the deployable shelf 10 shown in FIG. 2A from the storage position, the support members 55 may flex on the hinges 50, 60. The user may access the deployable shelf 10 with a hand and fingers at the lip region 5 (shown in FIG. 1) of the recessed portion 20 of the sidewall 25 to raise the deployable shelf 10 out of the recessed portion 20 of the sidewall 25. The user may deploy the shelf 10 from the storage position by sliding the hinges 50 up or down along the recessed portion 20 of the sidewall 25 to enable the shelf 10, support members 55 and hinges 50, 60 to deploy from within the recessed portion 20 of the sidewall 25 so that the deployable shelf 10 may be approximately parallel to the top surface 40 of the lid 35, where the deployable shelf 10 provides a level surface to support food and drink objects removed from the interior of the portable cooler 100.

Figure 2B:
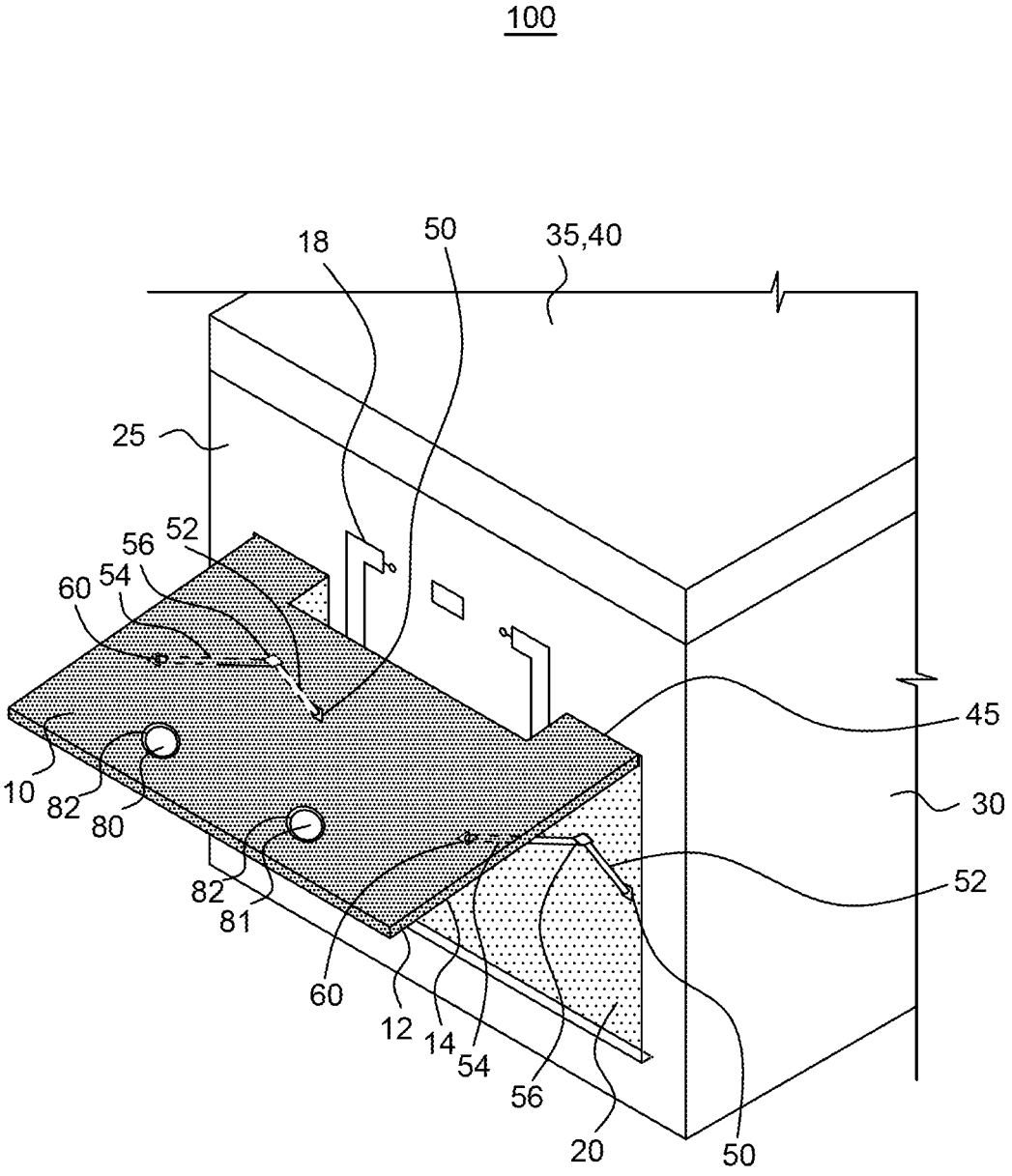
FIG. 2B shows a perspective view of a sidewall of the portable cooler with integrated, deployable shelves, where flexible support members with hinges are shown supporting a shelf as the shelf deploys out of a recessed portion within the sidewall.
Figure 2C:
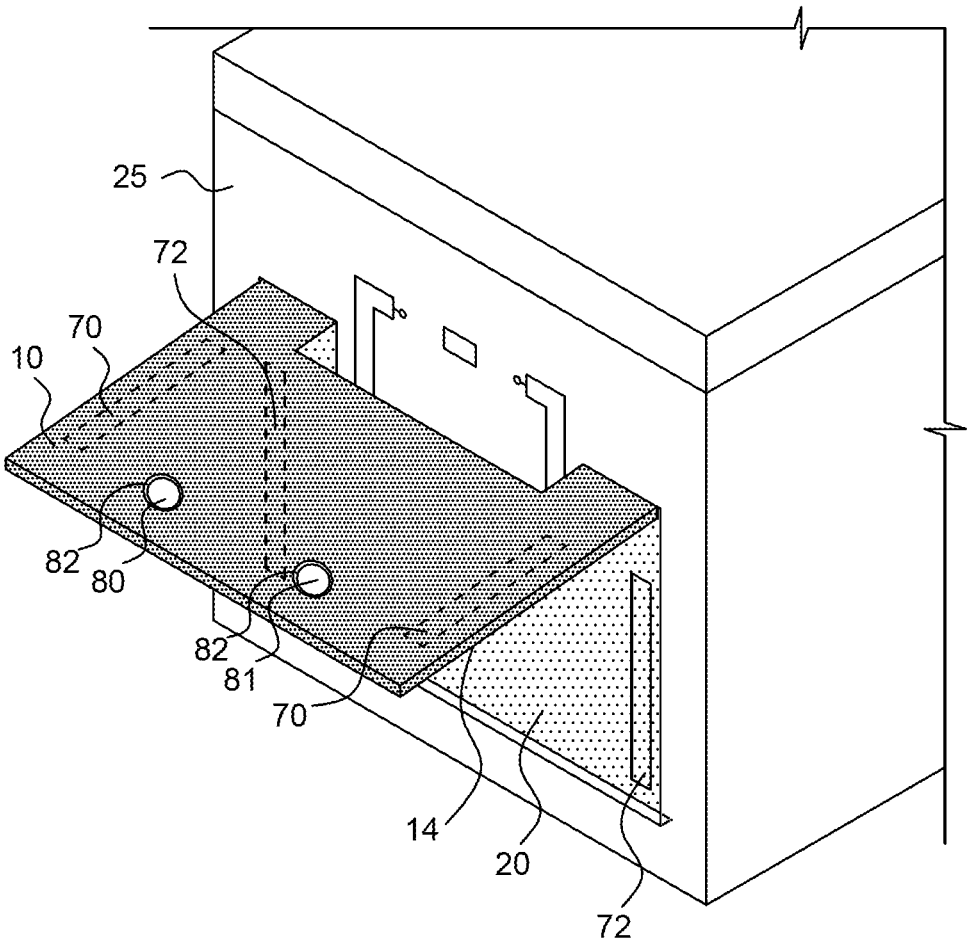
FIG. 2C shows a perspective view of a sidewall of the portable cooler with integrated, deployable shelves, with slots positioned within the recessed portion of the sidewall and within the underside of a shelf, where the flexible support members stow within the slots when the shelf is in the storage position within the recessed portion of the sidewall.

Referring to FIG. 2A in conjunction with FIG. 2C, to further accommodate the functionality of the deployable shelf 10 to stow within the recessed portion 20 of the sidewall 25, so that the shelf 10 is approximately flush with the sidewall 25 when in the storage position, in an embodiment the portable cooler 100 may feature slots 70, 72, as shown in FIG. 2C to provide additional storage space within the recessed portion 20 of the sidewall 25 for the support members 55 and hinges 50, 60 when the shelf 10 is in the storage position. More specifically, the support members 55 and hinges 50, 60 (not shown in FIG. 2C) may stow within the slots 70, 72 when the deployable shelf 10 is in the storage position within the recessed portion 20 of the sidewall 25. The cooler 100 may feature slots 70 within the underside 14 of the shelf 10 and/or slots 72 within the recessed portion 20 of the sidewall 25. The location of the hinges 50, 60 and support members 55 when the deployable shelf 10 is in the storage position may accommodate the functionality of the deployable shelf 10 to be approximately flush with the sidewall 25 when in the shelf 10 is in the storage position within the recessed portion 20 of the sidewall 25. In particular, hinges 50 may reside within the slots 72 within the recessed portion 20 of the sidewall 25, and hinges 60 may reside within the slots 70 within the underside 14 of the shelf 10. When a user wishes to collapse a deployable shelf 10 to the storage position within the recessed portion 20 of the sidewall 25, so that the shelf 10 may be flush with the sidewall 25, the user may slide the hinges 50 up or down along the recessed portion 20 of the sidewall 25 within the slots 72, thereby allowing the shelf 10 to collapse to the storage position while the support members 55 and hinges 50, 60 may also stow within the slots 70, 72. The slots 70, 72 may feature a suitable dimensional tolerance to accommodate the size of the hinges 50, 60 and support members 55 so that the deployable shelf 10 may be approximately flush with the sidewall 25 when the shelf 10 is in the storage position within the recessed portion 10 of the sidewall 25.

Referring to FIG. 2B, in an embodiment, the cooler 100 may include a support mechanism for the deployable shelf 10 with support members 52, 54 coupled to a middle hinge 56. For example, as shown in FIG. 2B, hinges 50 may be located within the recessed portion 20 of the sidewall 25, hinges 60 may be located on the underside 14 of the deployable shelf 10, and hinges 56 may be located between support members 52, 54. As shown in FIG. 2B, the support members 52, 54 may fold on hinge 56, so that the support members 52, 54 do not prohibit the deployable shelf 10 from collapsing into the storage position within the recessed portion 20 of the sidewall 25. Further, the depth 22, as shown in FIG. 2A, of the recessed portion 20 of the sidewall 25 may also include a suitable dimensional tolerance to allow the shelf 10, including the hinges 50, 56, 60 and support members 52, 54 to stow within the recessed portion 20 of the sidewall 25 in the storage position (as shown in FIG. 1) so that the shelf 10 may be approximately flush with the cooler sidewall 25. Because the depth 22 of the recessed portion 20 of the sidewall 25 may accommodate the dimensions of the hinges 50, 56, 60 and support members 52, 54, the shelf 10 may collapse and stow within the recessed portion 20, so that the shelf 10 does not protrude from the sidewall 25 when the shelf 10 is in the storage position within the recessed portion 20 of the sidewall 25.

Referring to FIG. 2B in conjunction with FIG. 2C, to further accommodate the functionality of the deployable shelf 10 to stow within the recessed portion 20 of the sidewall 25, so that the shelf 10 is approximately flush with the sidewall 25 when in the storage position, the portable cooler 100 of FIG. 2B may feature slots 70, 72, as shown in FIG. 2C, to provide additional storage space within the recessed portion 20 of the sidewall 25 for the support members 52, 54 and hinges 50, 56, 60 when the shelf 10 is in the storage position. More specifically, the support members 52, 54 and hinges 50, 56, 60 (not shown in FIG. 2C) may stow within the slots 70, 72 when the deployable shelf 10 is in the storage position within the recessed portion 20 of the sidewall 25. The cooler 100 may feature slots 70 within the underside 14 of the shelf 10 and/or slots 72 within the recessed portion 20 of the sidewall 25. The location of the hinges 50, 56, 60 and support members 52, 54 when the deployable shelf 10 is in the storage position may accommodate the functionality of the deployable shelf 10 to be approximately flush with the sidewall 25 when the shelf 10 is in the storage position within the recessed portion 20 of the sidewall 25. In particular, hinges 50 may reside within the slots 72 within the recessed portion 20 of the sidewall 25, and hinges 60 may reside within the slots 70 within the underside 14 of the shelf 10. When a user wishes to collapse a deployable shelf 10 to the storage position within the recessed portion 20 of the sidewall 25, so that the shelf 10 may be flush with the sidewall 25, the user may push the deployable shelf 10 down to the storage position, thereby allowing the shelf 10 to collapse to the storage position while the support members 52, 54 and hinges 50, 56, 60 may also stow within the slots 70, 72. The slots 70, 72 may feature a suitable dimensional tolerance to accommodate the size of the hinges 50, 56, 60 and support members 52, 54 so that the deployable shelf 10 may be approximately flush with the sidewall 25 when the shelf 10 is in the storage position within the recessed portion 20 of the sidewall 25. Of course, when the user wishes to raise the deployable shelf shown in FIG. 2B to the fully-deployed position for holding food and drink items, the user may access the deployable shelf 10 with a hand and fingers at the lip region 5 (shown in FIG. 1) of the recessed portion 20 of the sidewall 25 to raise the deployable shelf 10. When raising the deployable shelf 10 shown in FIG. 2B, the support members 52, 54 each flex on the hinges 50, 56, 60. Mechanisms for lockingly engaging the hinges 50, 56, 60 and support members 52, 54 to securely hold the deployable shelf 10 in the deployed position are known in the art and enable the deployable shelf 10 to support the weight of food and drink objects based on the known locking mechanism for the hinges 50, 56 60 and support members 52, 54. The support members 52, 54 may feature an appropriate length, as long or as short as necessary, to support the deployable shelf 10 in its horizontal, fully-deployed position to support food and drink items.

In addition, as shown in FIG. 2B, in an embodiment the deployable shelves 10 may feature cup depressions 80, 81 created by a circular depression having a suitable depth 82 and diameter to stabilize cups and other drink items on top of the deployable shelf 10 when in the fully-deployed position. The shelf 10 provides a support surface with cup depressions 80, 81 to accommodate the user's ability to support items on the deployable shelf 10. It is understood that the deployable shelf 10 may feature cup depressions 80, 81 at any location on the deployable shelf 10 and in larger diameters, to stabilize larger items, such as plates for food.

Figure 3:
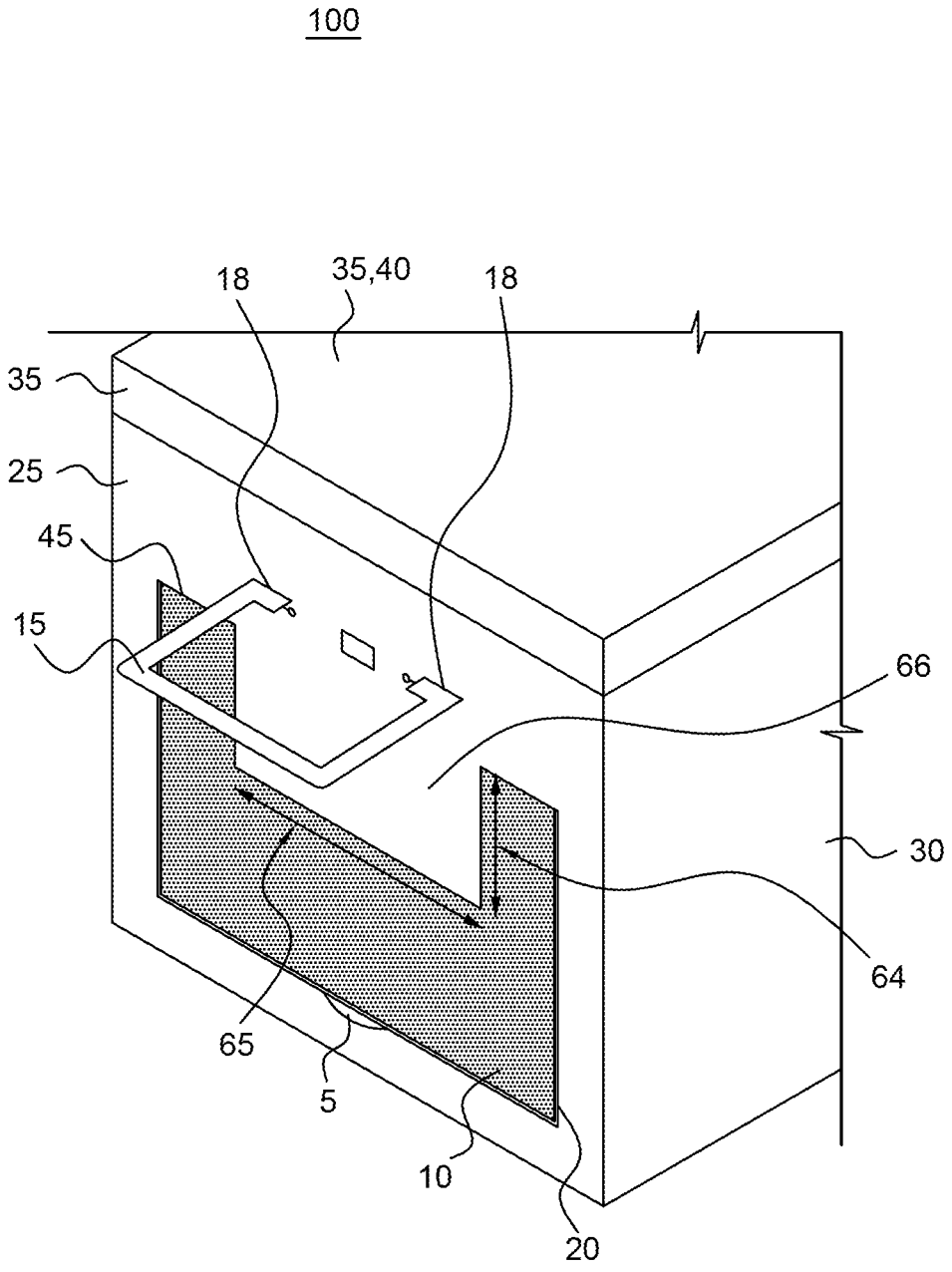
FIG. 3 shows a perspective view of a sidewall of the portable cooler with integrated, deployable shelves, where a shelf is shown in the storage position within a recessed portion of the sidewall and a deployable handle is in the raised position from the sidewall through a cut-out portion of the shelf.

Referring to FIG. 3, a perspective view of the sidewall 25 of the portable cooler 100 is shown where the deployable shelf 10 is in the storage position within the recessed portion 20 of the sidewall 25. As shown in FIG. 3, the deployable shelf 10 is approximately flush with the cooler sidewall 25 when folded down and not deployed when in the storage position. In addition, the deployable handle 15 within the cut-out portion 66 of the deployable shelf 10 is shown in an articulated position, as the handle 15 has been articulated on its hinges 18 from the sidewall 25 through the imaginary plane of the deployable shelf 10 via the cut-out portion 66 within the deployable shelf 10. As aforementioned, the cut-out portion 66 enables the user to articulate the handle 15 without interfering with or disturbing the deployable shelf 10, and conversely, the cut-out portion 66 enables the user to articulate the deployable shelf 10 without interfering with or disturbing the handle 15. The cut-out portion 66 may feature a width 64 and a length 65 to provide a suitable dimensional tolerance to accommodate the functionality of both the deployable shelf 10 and handle 15, so that neither the deployable shelf 10 nor handle 15 interferes with the respective articulation of the other.

Figure 4A:
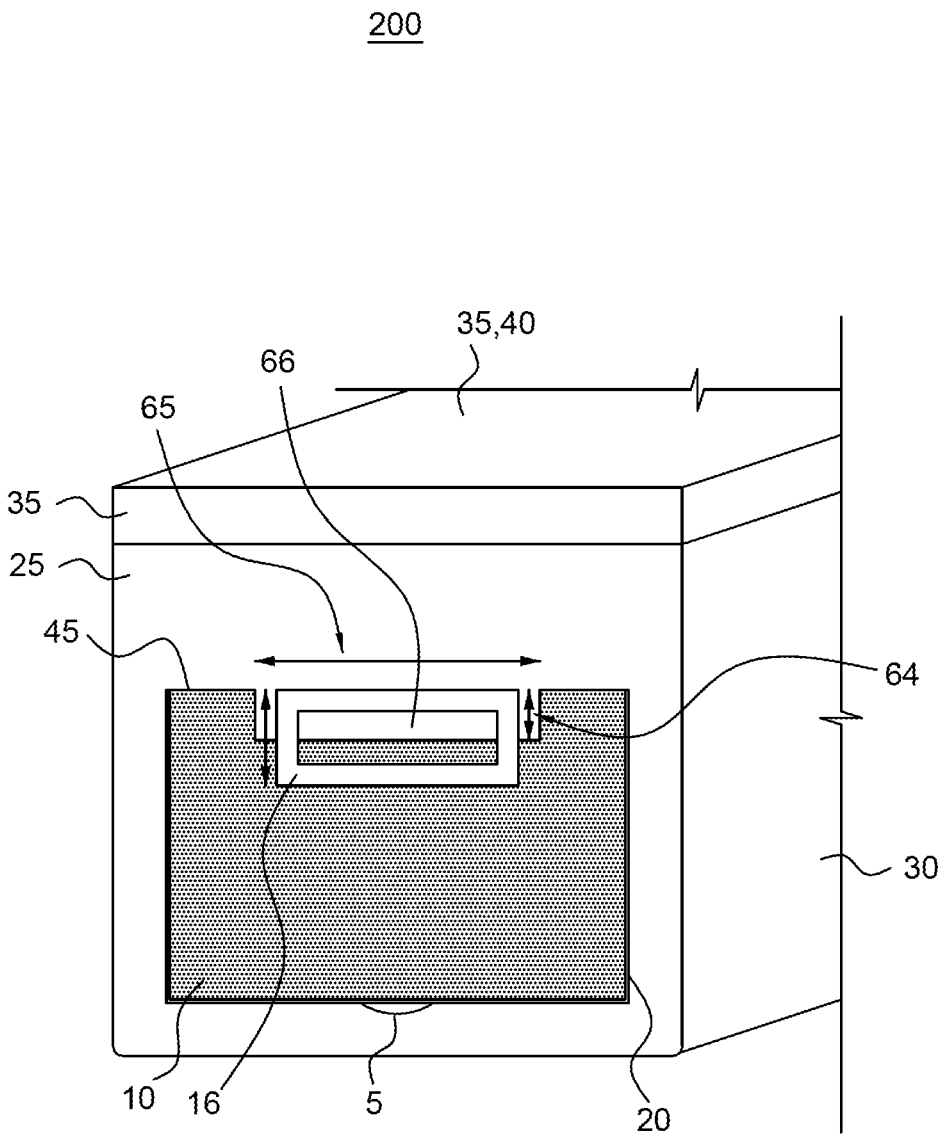
FIG. 4A shows a perspective view of a sidewall of another embodiment of the portable cooler with integrated, deployable shelves, where a shelf is shown in the storage position within a recessed portion of the sidewall and a slidable handle is seated on both the shelf and the sidewall.
Figure 4B:
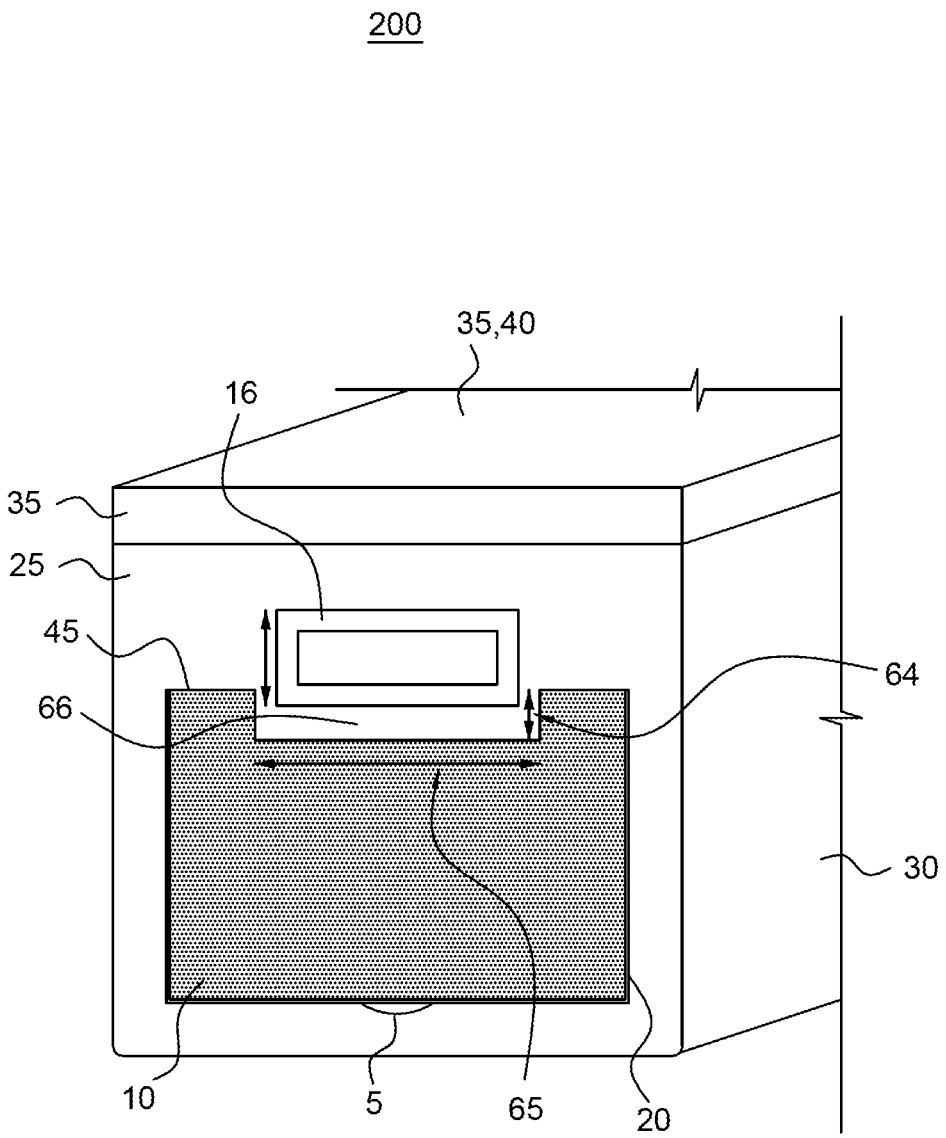
FIG. 4B shows a perspective view of a sidewall of another embodiment of the portable cooler with integrated, deployable shelves, where a shelf is shown in the storage position within a recessed portion of the sidewall and a slidable handle is seated on the sidewall above of the shelf.

FIGS. 4A-4B are diagrams of an example portable cooler 200 in which one or more disclosed embodiments may be implemented. In particular, FIG. 4A shows the portable cooler 200 where the slidable handle 16 may be seated on both the sidewall 25 and the deployable shelf 10 when the deployable shelf 10 is in the storage position within the recessed portion 20 of the sidewall 25, and FIG. 4B shows the portable cooler 200 where the slidable handle 16 is seated on the sidewall 25 to allow the deployable shelf 10 to articulate between the storage position and the deployed position. The portable cooler 200 of FIGS. 4A and 4B is shown from a side perspective view where the sidewall 25, front side 30, lid portion 35 and top surface 40 of the lid are visible. Although not shown, it is understood that the cooler 200 includes a rear side and an opposite sidewall, and that the opposite sidewall may include the same structures and mechanical features as the sidewall 25 shown in FIGS. 4A and 4B, such as the slidable handle 16 and shelf 10, which will be described in more detail. While the cooler 200 in FIGS. 4A and 4B is shown with a rectangular shape, it is understood that the cooler 200 may be formed in other shapes, such as a square, for example.

Referring to FIG. 4A, the sidewall 25 may include an integrated, deployable shelf 10 and a slidable handle 16. The deployable shelf 10 may couple to the cooler sidewall 25 at hinges 45, and the slidable handle 16 may couple to the cooler sidewall 25 via a known track mechanism that enables the handle 16 to remain attached to the sidewall 25 while having ability to slide up and down within a restricted range of motion along the sidewall 25, as indicated by the arrows in FIG. 4A. As shown in FIG. 4A, the deployable shelf 10 is shown in the storage position within a recessed portion 20 of the sidewall 25 of the cooler body, and the slidable handle 16 is seated on both the deployable shelf 10 and the sidewall 25. As will be discussed in more detail, a user may slide the slidable handle 16 up and off of the deployable shelf 10 to a raised position (as shown in FIG. 4B), so that the slidable handle 16 is only seated on the sidewall 25. When the slidable handle 16 is seated only on the sidewall 25, the user may then articulate the deployable shelf 10 out of the recessed portion 20 of the sidewall 25 (as shown in FIG. 5).

Referring to FIG. 4B, when the slidable handle is seated only on the sidewall 25, the slidable handle 16 is then oriented on the sidewall 25 within the cut-out portion 66 of the deployable shelf 10, to enable the deployable shelf 10 to freely articulate out of the recessed portion 20 of the sidewall 25 to the deployed position for use to hold food and drink objects. When a user wishes to articulate the deployable shelf 10 for use to the deployed position, the user may slide the slidable handle 16 upwards and off of the deployable shelf 10, so that the slidable handle 16 is seated only on the sidewall 25 and within the cut-out portion 66, so that the deployable shelf 10 may be articulated to the deployed position for use. The cut-out portion 66 enables the user to articulate the deployable shelf 10 without interfering with or disturbing the slidable handle 16. The cut-out portion 66 may feature a width 64 and a length 65 to provide a suitable dimensional tolerance to accommodate the functionality of both the deployable shelf 10 and slidable handle 16, so that the slidable handle 16 does not interfere with the articulation of the deployable shelf 10 and the deployable shelf 10 does not interfere with the slidable handle 16 when the handle 16 is in the raised position (as shown in FIG. 4B). The width 64 and the length 65 of the cut-out portion may provide a space to accommodate the ergonomic articulation of the deployable shelf 10 with respect to the slidable handle 16. As aforementioned, when in the raised position as shown in FIG. 4B, the slidable handle 16 is seated on the sidewall 25 to allow the deployable shelf 10 to articulate between the storage position (shown in FIGS. 4A-4B) and the deployed position (shown in FIG. 5). In addition to the functionality provided by the cut-out portion 66 to accommodate use of both the slidable handle 16 and shelf 10 on the same sidewall 25, a user may access the deployable shelf 10 with a hand and fingers at the lip region 5 of the recessed portion 20 of the sidewall 25 to raise the deployable shelf 10 out of the recessed portion 20 of the sidewall 25. Those skilled in the art would recognize that the material of the deployable shelf 10 may comprise a high-density plastic material or other similar material that is strong, yet light, to accommodate the portability of the cooler 200 and functionality of the deployable shelf 10 for supporting food and drink objects.

Referring again to FIG. 4B, when in the storage position within the recessed portion 20 of the sidewall 25, the deployable shelf 10 is approximately flush with the sidewall 25 so that the exterior surfaces of the sidewall 25 and shelf 10 are approximately even with the imaginary plane running tangentially parallel to the sidewall 25. The deployable shelf 10 may be approximately as large as the dimensions of the sidewall 25 of the cooler, while also having a suitable dimensional tolerance that accommodates the functionality for the deployable shelf 10 to collapse and stow within the recessed portion 20 of the cooler sidewall 25, so that the deployable shelf 10 is approximately flush with the cooler sidewall 25 when folded down and not deployed. It is understood that the recessed portion 20 may also feature a suitable dimensional tolerance that accommodates the functionality for the shelf 10 to collapse and stow within the recessed portion 20 of the cooler sidewall 25. For example, the recessed portion 20 may be as wide as the sidewall 25 to accommodate a shelf 10 that is approximately as large as the dimensions of the sidewall 25.

Figure 5:
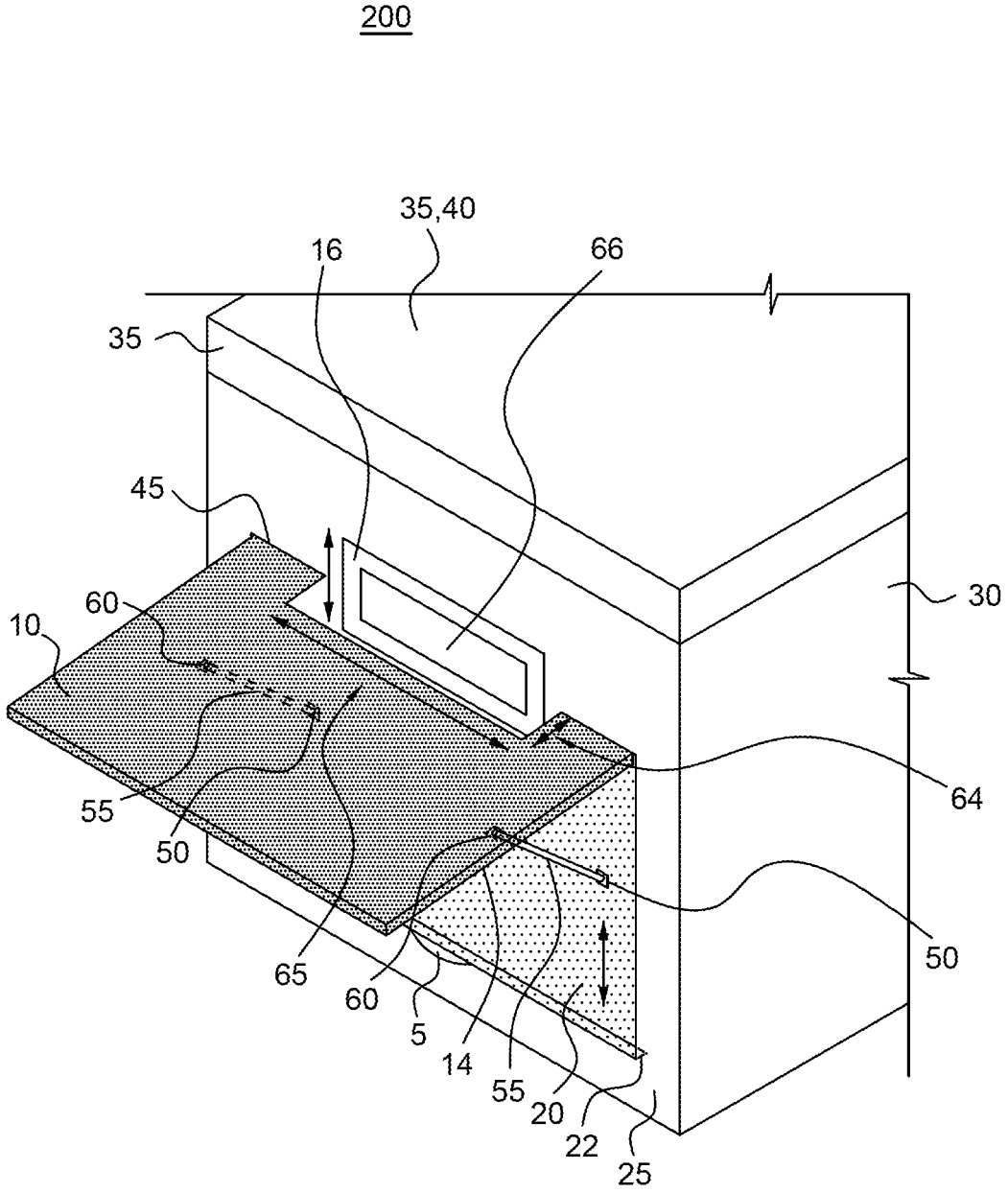
FIG. 5 shows a perspective view of a sidewall of another embodiment of the portable cooler with integrated, deployable shelves, where a shelf is shown in the deployed position while a slidable handle is seated behind the raised shelf against the sidewall.

Referring to FIG. 5, a perspective view of the sidewall 25 of the portable cooler 200 is shown where the deployable shelf 10 is partially deployed out of the recessed portion 20 of the sidewall 25 in the deployed position. It is understood that when the deployable shelf 10 is in the fully-deployed position outside of the recessed portion 20 of the sidewall 25, the deployable shelf 10 may be approximately parallel to the top surface 40 of the lid 35, so that the deployable shelf 10 provides a level surface to support food and drink objects removed from the interior of the portable cooler 200.

Referring again to FIG. 5, the deployable shelf 10 may include a height/depth 12 as shown in FIG. 2A, and the recessed portion 20 may also include a depth 22 having a suitable dimensional tolerance to receive the deployable shelf 10 so that the deployable shelf 10 is approximately flush with the cooler sidewall 25 when folded down and in the storage position (as shown in FIGS. 4A-4B). The depth 22 of the recessed portion 20 of the sidewall 25 may provide the recessed portion 20 with a suitable dimensional tolerance to accommodate the functionality for the deployable shelf 10 to collapse and stow within the recessed portion 20 of the cooler sidewall 25. Mechanisms for lockingly engaging the hinges 50, 60 and support members 55 to securely hold the deployable shelf 10 in the deployed position are known in the art and enable the deployable shelf 10 to support the weight of food and drink objects based on the known locking mechanism for the hinges 50, 60 and support members 55.

As shown in FIG. 5, the cooler 200 may include hinges 50 located within the recessed portion 20 of the sidewall 25 that each couple to a support member 55 that extends to an additional hinge 60 located on the underside 14 of the deployable shelf 10. The hinges 50, 60 and support members 55 stabilize the deployable shelf 10 to secure the deployable shelf 10 while in the storage position within the recessed portion 20 of the sidewall 25 (as shown in FIGS. 4A-4B), during articulation between the storage and deployed positions, and while in the deployed position where the deployable shelf 10 is approximately parallel to the top surface 40 of the lid 35 (as shown in FIG. 5). Although the embodiment of FIG. 5 shows two support members 55, each accompanied by hinges 50, 60, it is understood that the cooler 200 may feature one support member with hinges that may stabilize the deployable shelf 10 to secure the deployable shelf 10 while in the storage position within the recessed portion 20 of the sidewall 25, during articulation between the storage and deployed positions, and while in the deployed position where the deployable shelf 10 is approximately parallel to the top surface 40 of the lid 35. When a user wishes to raise the deployable shelf 10 shown in FIG. 5 to the fully-deployed position for holding food and drink items, the user may access the deployable shelf 10 with a hand and fingers at the lip region 5 of the recessed portion 20 of the sidewall 25 to raise the deployable shelf 10 out of the recessed portion 20 of the sidewall 25. When raising the deployable shelf 10 shown in FIG. 5, the support members 55 flex on the hinges 50, 60. Mechanisms for lockingly engaging the hinges 50, 60 and support members 55 to securely hold the deployable shelf 10 in the deployed position are known in the art and enable the deployable shelf 10 to support the weight of food and drink objects based on the known locking mechanism for the hinges 50, 60 and support members 55. The support members 55 may feature an appropriate length, as long or as short as necessary, to support the deployable shelf 10 in its horizontal, fully-deployed position to support food and drink items.

In addition, as indicated by the arrows adjacent to hinges 50 in FIG. 5, the hinges 50 may slide up or down along the recessed portion 20 of the sidewall 25, so that the support members 55 do not prohibit the deployable shelf 10 from collapsing into the storage position within the recessed portion 20 of the sidewall 25. For example, when a user wishes to fold the deployable shelf 10 down into the storage position within the recessed portion 20 of the sidewall 25, the user may apply pressure to the shelf 10 to fold the shelf 10 down while sliding the hinges 50 up or down along the recessed portion 20 of the sidewall 25 to enable the shelf 10, support members 55 and hinges 50, 60 to stow within the recessed portion 20 of the sidewall 25 so that the shelf 10 may be approximately flush with the sidewall 25 when the shelf 10 is in the storage position. When folding the shelf 10 down into the storage position, the support members 55 may flex on the hinges 50, 60. Mechanisms for lockingly engaging the slidable hinges 50 in place to securely hold the deployable shelf 10 in the deployed position are known in the art and enable the deployable shelf 10 to support the weight of food and drink objects based on the known locking mechanism for the slidable hinges 50. Further, the depth 22 of the recessed portion 20 of the sidewall 25 may also include a suitable dimensional tolerance to allow the shelf 10, including the hinges 50, 60 and support members 55, to stow within the recessed portion 20 of the sidewall 25 in the storage position (as shown in FIGS. 4A and 4B), so that the shelf 10 may be approximately flush with the cooler sidewall 25. Because the depth 22 of the recessed portion 20 of the sidewall 25 may accommodate the dimensions of the hinges 50, 60 and support member 55, the shelf 10 may collapse and stow within the recessed portion 20, so that the shelf 10 does not protrude from the sidewall 25 when the shelf 10 is in the storage position within the recessed portion 20 of the sidewall 25.

When raising the deployable shelf 10 shown in FIG. 5 from the storage position, the support members 55 may flex on the hinges 50, 60. The user may access the deployable shelf 10 with a hand and fingers at the lip region 5 (shown in FIG. 1) of the recessed portion 20 of the sidewall 25 to raise the deployable shelf 10 out of the recessed portion 20 of the sidewall 25. The user may deploy the shelf 10 from the storage position by sliding the hinges 50 up or down along the recessed portion 20 of the sidewall 25 to enable the shelf 10, support members 55 and hinges 50, 60 to deploy from within the recessed portion 20 of the sidewall 25 so that the deployable shelf 10 may be approximately parallel to the top surface 40 of the lid 35, where the deployable shelf 10 provides a level surface to support food and drink objects removed from the interior of the portable cooler 200.

Referring to FIG. 5 in conjunction with FIG. 2C, to further accommodate the functionality of the deployable shelf 10 to stow within the recessed portion 20 of the sidewall 25, so that the shelf 10 is approximately flush with the sidewall 25 when in the storage position, the portable cooler 200 shown in FIG. 5 may feature the slots 70, 72, as shown in FIG. 2C to provide additional storage space within the recessed portion 20 of the sidewall 25 for the support members 55 and hinges 50, 60 when the shelf 10 is in the storage position. More specifically, the support members 55 and hinges 50, 60 (not shown in FIG. 2C) may stow within the slots 70, 72 when the deployable shelf 10 is in the storage position within the recessed portion 20 of the sidewall 25. The cooler 200 may feature slots 70 within the underside 14 of the shelf 10 and/or slots 72 within the recessed portion 20 of the sidewall 25. The location of the hinges 50, 60 and support members 55 may accommodate the functionality of the deployable shelf 10 to be approximately flush with the sidewall 25 when in the shelf 10 is in the storage position within the recessed portion 20 of the sidewall 25. In particular, hinges 50 may reside within the slots 72 within the recessed portion 20 of the sidewall 25, and hinges 60 may reside within the slots 70 within the underside 14 of the shelf 10. When a user wishes to collapse a deployable shelf 10 to the storage position within the recessed portion 20 of the sidewall 25, so that the shelf 10 may be flush with the sidewall 25, the user may slide the hinges 50 up or down along the recessed portion 20 of the sidewall 25 within the slots 72, thereby allowing the shelf 10 to collapse to the storage position while the support members 55 may also stow within the slots 70, 72. The slots 70, 72 may feature a suitable dimensional tolerance to accommodate the size of the hinges 50, 60 and support members 55 so that the deployable shelf 10 may be flush with the sidewall 25 when the shelf 10 is in the storage position within the recessed portion 10 of the sidewall.

Referring to FIG. 5 in conjunction with FIG. 2B, in an embodiment, the portable cooler 200 shown in FIG. 5 may include a support mechanism for the deployable shelf 10 with the support members 52, 54 with middle hinge 56, as shown in FIG. 2B. For example, as shown in FIG. 2B, hinges 50 may be located within the recessed portion 20 of the sidewall 25, hinges 60 may be located on the underside 14 of the deployable shelf 10, and hinges 56 may be located between support members 52, 54. As shown in FIG. 2B, the support members 52, 54 may fold on hinge 56, so that the support members 52, 54 do not prohibit the deployable shelf 10 from collapsing into the storage position within the recessed portion 20 of the sidewall 25. Further, in the embodiment of FIG. 5, the depth 22 of the recessed portion 20 of the sidewall 25 may also include a suitable dimensional tolerance to allow the shelf 10, including the hinges 50, 56, 60 and support members 52, 54 to stow within the recessed portion 20 of the sidewall 25 in the storage position (as shown in FIGS. 4A and 4B) so that the shelf 10 may be approximately flush with the cooler sidewall 25. Because the depth 22 of the recessed portion 20 of the sidewall 25 may accommodate the dimensions of the hinges 50, 56, 60 and support members 52, 54, the shelf 10 may collapse and stow within the recessed portion 20, so that the shelf 10 does not protrude from the sidewall 25 when the shelf 10 is in the storage position within the recessed portion 20 of the sidewall 25.

Referring again to an embodiment of the cooler 200 as shown in FIG. 5 in conjunction with the support members 52, 54 with middle hinge 56 as shown in FIG. 2B, to further accommodate the functionality of the deployable shelf 10 to stow within the recessed portion 20 of the sidewall 25, so that the shelf 10 is approximately flush with the sidewall 25 when in the storage position, the portable cooler 200 shown in FIG. 5 may also feature the slots 70, 72, as shown in FIG. 2C to provide additional storage space within the recessed portion 20 of the sidewall 25 for the support members 52, 54 and hinges 50, 56, 60 (as shown in FIG. 2B) when the shelf 10 is in the storage position. More specifically, the support members 52, 54 and hinges 50, 56, 60 may stow within the slots 70, 72 when the deployable shelf 10 is in the storage position within the recessed portion 20 of the sidewall 25. The cooler 200 may feature slots 70 within the underside 14 of the shelf 10 and/or slots 72 within the recessed portion 20 of the sidewall 25. The location of the hinges 50, 56, 60 and support members 52, 54 may accommodate the functionality of the deployable shelf 10 to be approximately flush with the sidewall 25 when in the shelf is in the storage position within the recessed portion 20 of the sidewall 25. In particular, hinges 50 may reside within the slots 72 within the recessed portion 20 of the sidewall 25, and hinges 60 may reside within the slots 70 within the underside 14 of the shelf 10. When a user wishes to collapse a deployable shelf 10 to the storage position within the recessed portion 20 of the sidewall 25, so that the shelf 10 may be flush with the sidewall 25, the user may push the deployable shelf 10 down to the storage position, thereby allowing the shelf 10 to collapse to the storage position while the support members 52, 54 and hinges 50, 56, 60 may also stow within the slots 70, 72. The slots 70, 72 may feature a suitable dimensional tolerance to accommodate the size of the hinges 50, 56, 60 and support members 52, 54 so that the deployable shelf 10 may be flush with the sidewall 25 when the shelf 10 is in the storage position within the recessed portion 10 of the sidewall.

In an embodiment of the cooler 200 featuring the support members 52, 54 with middle hinge 56, as shown in FIG. 5 in conjunction with FIG. 2B, when the user wishes to raise the deployable shelf 10 to the fully-deployed position for holding food and drink items, the user may access the deployable shelf 10 with a hand and fingers at the lip region 5 of the recessed portion 20 of the sidewall 25 to raise the deployable shelf. When raising the deployable shelf 10, the support members 52, 54 flex on the middle hinge 56. Mechanisms for lockingly engaging the hinges 50, 56 60 and support members 52, 54 to securely hold the deployable shelf 10 in the deployed position are known in the art and enable the deployable shelf 10 to support the weight of food and drink objects based on the known locking mechanism for the hinges 50, 56 60 and support members 52, 54. The support members 52, 54 may feature an appropriate length, as long or as short as necessary, to support the deployable shelf 10 in its horizontal, fully-deployed position to support food and drink items.

In addition, referring again to FIG. 5 in conjunction with FIG. 2B, the deployable shelves may feature the cup depressions 80, 81 shown in FIG. 2B, created by a circular depression having a suitable depth 82 and diameter to stabilize cups and other drink items on top of the deployable shelf 10 when in the fully-deployed position. The shelf 10 provides a support surface with cup depressions 80, 81 to accommodate the user's ability to support items on the deployable shelf 10. It is understood that the deployable shelf 10 may feature cup depressions 80, 81 at any location on the deployable shelf 10 and in larger diameters, to stabilize larger items, such as plates for food.

Figure 6:
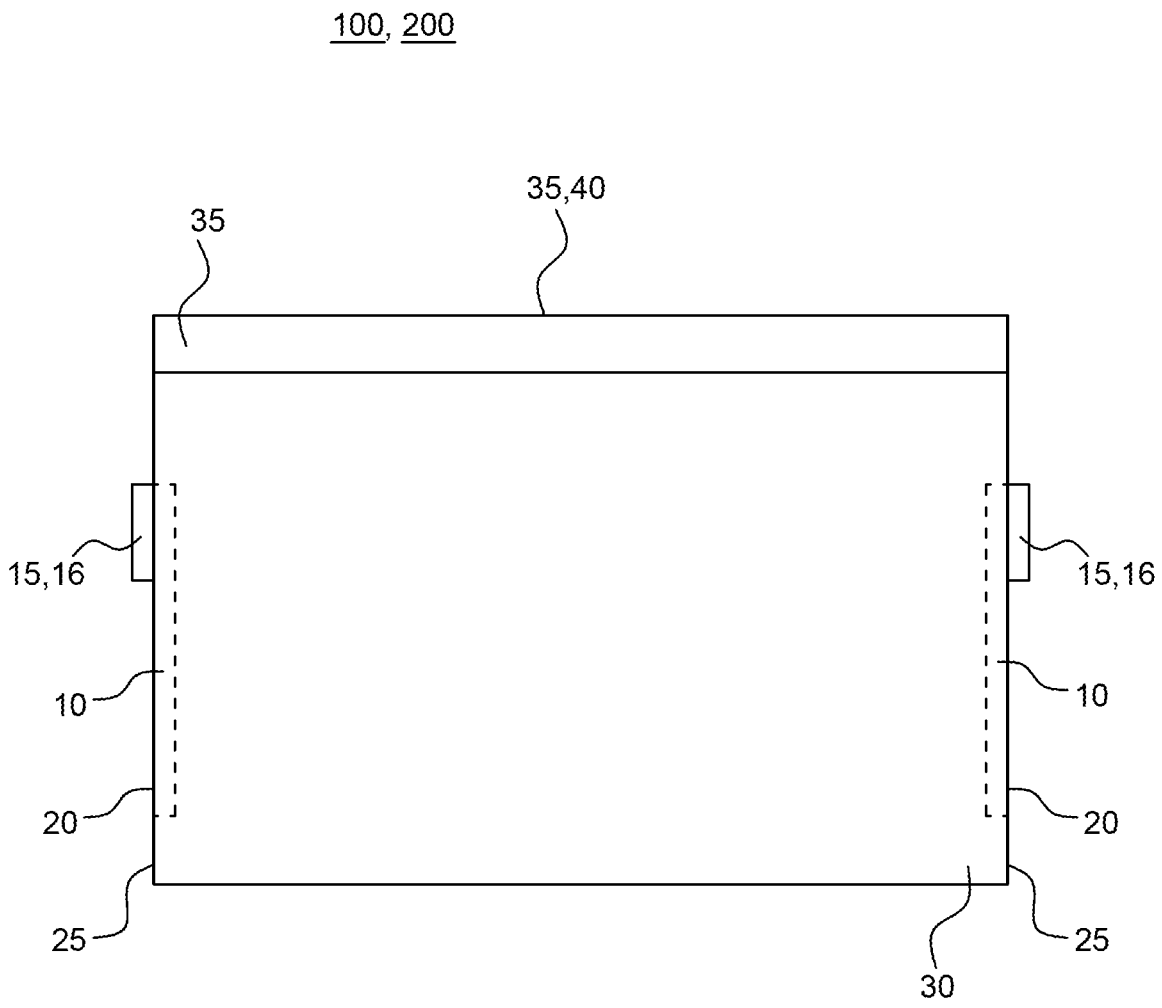
FIG. 6 shows a perspective view of the front of the portable cooler with integrated, deployable shelves, where the shelves are shown in the storage position within recessed portions of the sidewall, while the deployable handles are in the resting position against the sidewalls.
Figure 7:
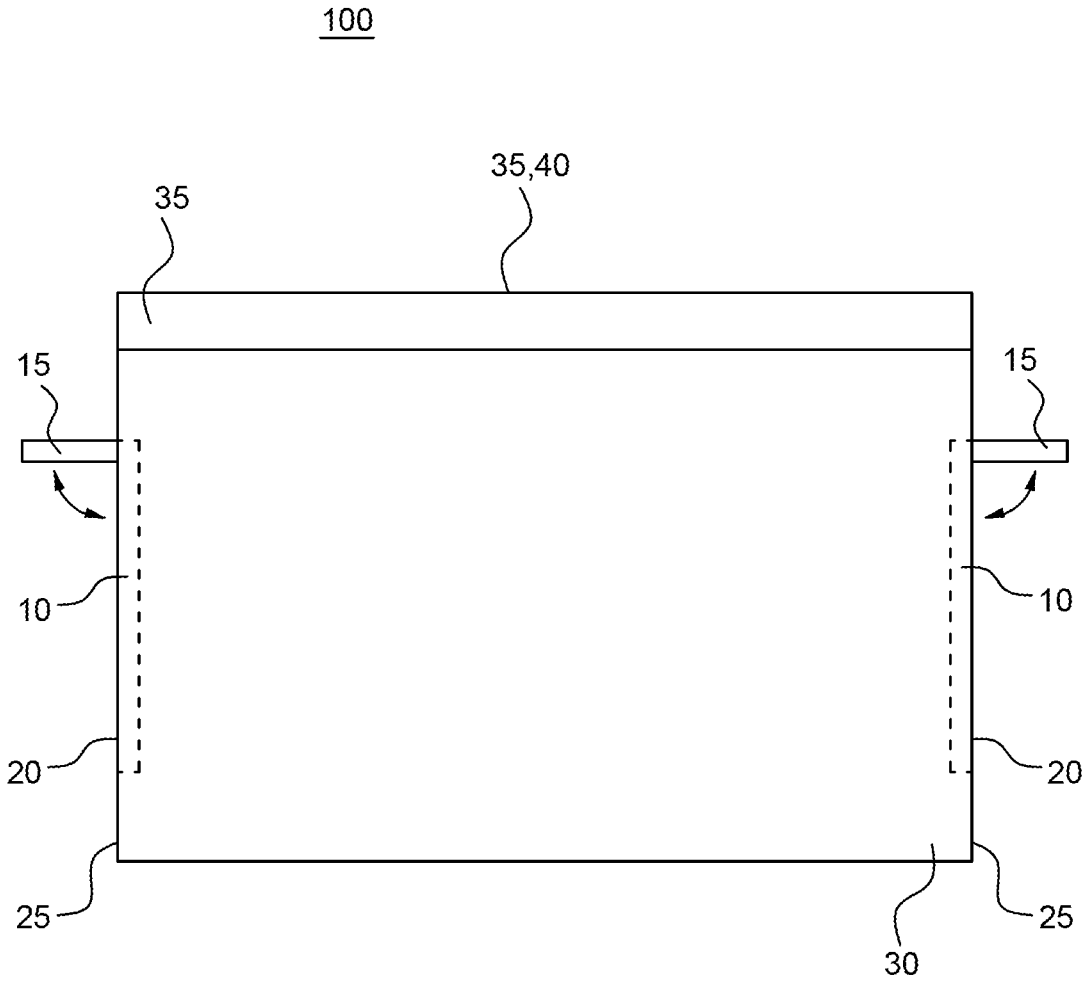
FIG. 7 shows a perspective view of the front of the portable cooler with integrated, deployable shelves, where the shelves are shown in the storage position within recessed portions of the sidewall, while the deployable handles are in a raised position from the sidewalls through the cut-out portion of the shelves.

Referring to FIG. 6, a perspective view of the front 30 of the portable cooler 100, 200 of the herein described embodiments is shown, where a shelf 10 on each sidewall 25 is stowed within the recessed portion 20 of each sidewall 25 in the storage position, and the handles 15, 16 are shown on the sidewalls 25. When the deployable shelf 10 is in the storage position, the ergonomic position of the deployable shelf 10 within the sidewall 25 accommodates the portability of the cooler 100, 200 while maintaining functionality for a user to grasp the handles 15, 16 to transport the cooler. As discussed previously, the embodiments of the cooler 100, 200 described herein may respectively feature deployable handles 15 or slidable handles 16. The deployable handles 15 may articulate from a resting position against the sidewall 25 (as shown in FIG. 6) to a raised, deployed position approximately parallel to the lid (as shown in FIG. 7), to allow a user to grasp the deployable handles 15 and lift the cooler 100. In contrast, the slidable handles may remain attached to the sidewall, as shown in FIG. 6, so that a user may utilize the slidable handles 16 to grasp and lift the portable cooler 200.

Referring to FIGS. 6 and 7, when in the storage position, the deployable shelf 10 is approximately flush with the sidewall 25 so that the exterior surfaces of the sidewall 25 and shelf 10 are approximately even with the imaginary plane running tangentially parallel to the sidewall 25. The deployable shelf 10 may be approximately as large as the dimensions of the sidewall 25 of the cooler, while also having a suitable dimensional tolerance that accommodates the functionality for the deployable shelf 10 to collapse and stow within the recessed portion 20 of the cooler sidewall 25, so that the deployable shelf 10 is approximately flush with the cooler sidewall 25 when folded down and not deployed. It is understood that the recessed portion 20 may also feature a suitable dimensional tolerance that accommodates the functionality for the shelf 10 to collapse and stow within the recessed portion 20 of the cooler sidewall 25. For example, the recessed portion 20 may be as wide as the sidewall 25 to accommodate a shelf 10 that is approximately as large as the dimensions of the sidewall 25. As seen in FIGS. 6 and 7, the deployable shelf 10 does not protrude from the sidewall 25 when the deployable shelf 10 in the storage position, which enhances the portability and ability to store the cooler 100, 200.

Figure 8:
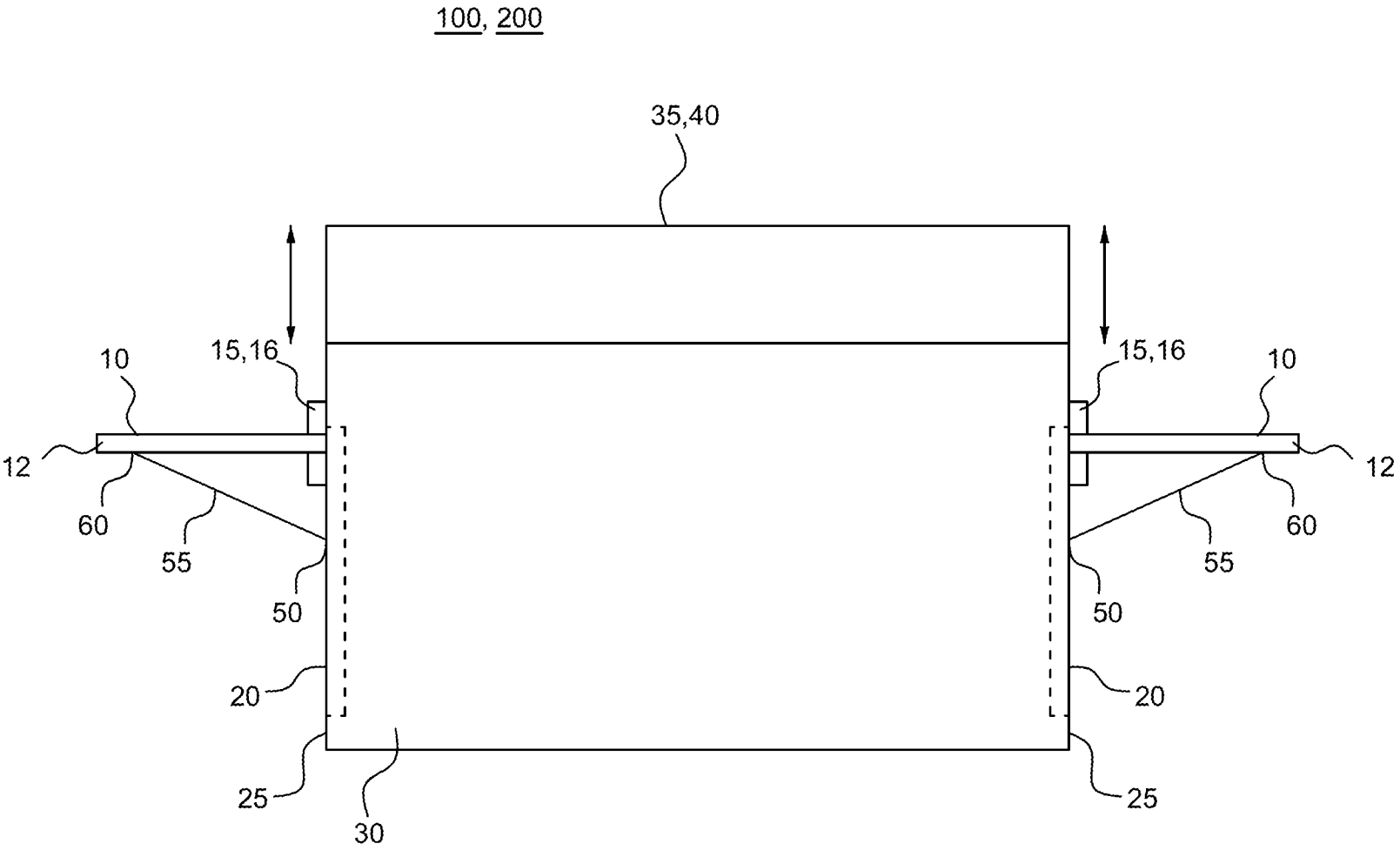
FIG. 8 shows a perspective view of the front of the portable cooler with integrated, deployable shelves, where the shelves are shown in the deployed position while the deployable handles are in the resting position against the sidewalls, while the lid is in the open position.

Referring to FIG. 8, an additional perspective view of the front 30 of the portable cooler 100, 200 of the herein described embodiments is shown, where the deployable shelf 10 is in the deployed position for holding food and drink objects, which may be removed from the interior of the cooler 100, 200 when the lid 35 is open, as shown in FIG. 8. When the deployable shelf 10 is in the deployed position as shown in FIG. 8, the hinges 50, 60 and support members 55 hold the deployable shelf 10 in the deployed position to support the food and drink objects on the deployable shelf 10. As aforementioned, mechanisms for lockingly engaging the hinges 50, 60 and support members 55 to securely hold the deployable shelf 10 in the deployed position are known in the art and enable the deployable shelf 10 to support the weight of food and drink objects based on the known locking mechanism for the hinges 50, 60 and support members 55. When in the deployed position, the height/depth 12 of the deployable shelf 10 is also visible, and it is understood that the recessed portion 20 of the sidewall 25 features a suitable dimensional tolerance to enable the deployable shelf 10 to fit within the recessed portion 20 of the sidewall 25 when in the storage position. In addition, the cut-out portion 66 (not shown in FIG. 8) allows the shelf to remain in the deployed position without interfering with or disturbing either the deployable handle 15 or slidable handle 16 of the respective embodiments 100, 200.

Having thus described the present embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the embodiment are possible which do not alter, with respect to those parts, the inventive concepts and principles embodied therein. The present embodiments and optional configurations are therefore to be considered in all respects as exemplary and/or illustrative and not restrictive, of the scope of the invention being indicated by the appended claims rather than by the foregoing description, and all alternate embodiments and changes to this embodiment which come within the meaning and range of equivalency of said claims are therefore to be embraced therein.

What is claimed is:

1. A portable cooler comprising:

a body including a lid and at least one of a sidewall including:

a shelf disposed at the at least one sidewall, a cut-out portion within the shelf, a recessed portion within the at least one sidewall, and a handle coupled to the at least one sidewall;

wherein the shelf is configured to articulate between a storage position within the recessed portion and a deployed position approximately parallel to the lid;

wherein the shelf is approximately flush with the at least one sidewall when in the storage position;

wherein the handle is configured to articulate through the cut-out portion between a resting position against the at least one sidewall and a raised position approximately parallel to the lid; and wherein the cut-out portion is configured to allow the shelf to articulate without interfering with the handle and the handle to articulate without interfering with the shelf.

2. The portable cooler of claim 1, wherein the at least one sidewall further comprises:

at least one support member having a first end coupled to a first hinge disposed on the recessed portion and a second end coupled to a second hinge disposed on an underside of the shelf;

the at least one support member configured to:

support the shelf while in the storage position within the recessed portion of the sidewall and;

support the shelf while in the deployed position such that the shelf is approximately parallel to a top surface of the lid.

3. The portable cooler of claim 2, wherein the underside of the shelf further includes a first slot and the recessed portion further includes a second slot, the first and second slots configured to receive the at least one support member, the first hinge and the second hinge when the shelf articulates to the storage position.

4. The portable cooler of claim 2, wherein the first hinge is operable to slide up or down along the recessed portion to allow the shelf to articulate between the storage position and the deployed position.

5. The portable cooler of claim 1, wherein the at least one sidewall further comprises at least one of a support mechanism comprising:

a first support member having a first end and a second end, the first end coupled to a first hinge disposed on the recessed portion;

a second support member having a primary end and a secondary end, the primary end coupled to a second hinge disposed on an underside of the shelf;

a middle hinge disposed between the first support member and the second support member and coupled to the second end of the first support member and the secondary end of the second support member;

the support mechanism configured to:

stabilize the shelf while in the storage position within the recessed portion of the sidewall;

stabilize the shelf while in the deployed position such that the shelf is approximately parallel to a top surface of the lid; and stabilize the shelf during articulation of the shelf between the storage position and the deployed position.

6. The portable cooler of claim 5, wherein the underside of the shelf further includes a first slot and the recessed portion further includes a second slot, the first and second slots configured to receive the first support member, the second support member, the first hinge, the middle hinge, and the second hinge when the shelf articulates to the storage position.

7. The portable cooler of claim 1, wherein the shelf further comprises a height and the recessed portion further comprises a depth;

the depth of the recessed portion configured to receive the height of the shelf upon articulation of the shelf from the deployed position to the storage position;

wherein the shelf is approximately flush with the at least one sidewall when in the storage position.

8. The portable cooler of claim 1, wherein the cut-out portion further comprises a space;

the space of the cut-out portion configured to allow the handle to articulate through the space without interfering with the shelf, and the space of the cut-out portion configured to allow the shelf to articulate past the handle without interfering with the handle;

wherein the space comprises a dimensional tolerance so that neither the shelf touches the handle nor the handle touches the shelf during articulation of either the shelf or the handle.

9. The portable cooler of claim 1, wherein the shelf further comprises a plurality of cup depressions configured to stabilize items on a support surface of the shelf when the shelf is in the deployed position.

10. A portable cooler comprising:

a body including a lid and at least one of a sidewall including:

a shelf disposed at the at least one sidewall, a cut-out portion within the shelf, a recessed portion within the at least one sidewall, and a handle coupled to the at least one sidewall;

wherein the shelf is configured to articulate between a storage position within the recessed portion and a deployed position approximately parallel to the lid;

wherein the shelf is approximately flush with the at least one sidewall when in the storage position;

wherein the handle is operatively configured to slide within the cut-out portion onto the shelf when the shelf is in the storage position and thereafter slide within the cut-out portion and off of the shelf and onto the at least one sidewall to allow the shelf to articulate from the storage position to the deployed position; and wherein the cut-out portion is configured to allow the shelf to articulate without interfering with the handle and the handle to slide without interfering with the shelf.

11. The portable cooler of claim 10, wherein the at least one sidewall further comprises:

at least one of a support member having a first end coupled to a first hinge disposed on the recessed portion and a second end coupled to a second hinge disposed on an underside of the shelf;

the at least one support member configured to:

support the shelf while in the storage position within the recessed portion of the sidewall; and support the shelf while in the deployed position such that the shelf is approximately parallel to a top surface of the lid.

12. The portable cooler of claim 11, wherein the underside of the shelf further includes a first slot and the recessed portion further includes a second slot, the first and second slots configured to receive the at least one support member, the first hinge and the second hinge when the shelf articulates to the storage position.

13. The portable cooler of claim 11, wherein the first hinge is operable to slide up or down along the recessed portion to allow the shelf to articulate between the storage position and the deployed position.

14. The portable cooler of claim 10, wherein the at least one sidewall further comprises at least one of a support mechanism comprising:

a first support member having a first end and a second end, the first end coupled to a first hinge disposed on the recessed portion;

a second support member having a primary end and a secondary end, the primary end coupled to a second hinge disposed on an underside of the shelf;

a middle hinge disposed between the first support member and the second support member and coupled to the second end of the first support member and the secondary end of the second support member;

the support mechanism configured to:

stabilize the shelf while in the storage position within the recessed portion of the sidewall;

stabilize the shelf while in the deployed position such that the shelf is approximately parallel to a top surface of the lid; and stabilize the shelf during articulation of the shelf between the storage position and the deployed position.

15. The portable cooler of claim 14, wherein the underside of the shelf further includes a first slot and the recessed portion further includes a second slot, the first and second slots configured to receive the first support member, the second support member, the first hinge, the middle hinge, and the second hinge when the shelf articulates to the storage position.

16. The portable cooler of claim 10, wherein the shelf further comprises a height and the recessed portion further comprises a depth;

the depth of the recessed portion configured to receive the height of the shelf upon articulation of the shelf from the deployed position to the storage position;

wherein the shelf is approximately flush with the at least one sidewall when in the storage position.

17. The portable cooler of claim 10, wherein the cut-out portion further comprises a space;

the space of the cut-out portion configured to allow the handle to slide within the space without interfering with the shelf, and the space of the cut-out portion configured to allow the shelf to articulate past the handle without interfering with the handle;

wherein the space comprises a dimensional tolerance so that neither the shelf touches the handle nor the handle touches the shelf during articulation of the shelf or sliding of the handle.

18. The portable cooler of claim 10, wherein the shelf further comprises a plurality of cup depressions configured to stabilize items on a support surface of the shelf when the shelf is in the deployed position.

19. A portable cooler comprising:

a body including a lid and at least one of a sidewall including:

a shelf disposed at the at least one sidewall, a cut-out portion within the shelf, a recessed portion within the at least one sidewall, and a handle coupled to the at least one sidewall;

wherein the shelf is configured to articulate between a storage position within the recessed portion and a deployed position approximately parallel to the lid;

wherein the shelf is approximately flush with the at least one sidewall when in the storage position; and wherein the cut-out portion is configured to allow the shelf to articulate without interfering with the handle and the handle to slide within the cut-out portion without interfering with the shelf.

20. The portable cooler of claim 19, wherein the at least one sidewall further comprises at least one of a support mechanism comprising:

a first support member having a first end and a second end, the first end coupled to a first hinge disposed on the recessed portion;

a second support member having a primary end and a secondary end, the primary end coupled to a second hinge disposed on an underside of the shelf;

a middle hinge disposed between the first support member and the second support member and coupled to the second end of the first support member and the secondary end of the second support member;

the support mechanism configured to:

support the shelf while in the storage position within the recessed portion of the sidewall; and support the shelf while in the deployed position such that the shelf is approximately parallel to a top surface of the lid.

* * * * *